United States Patent [19]

Fah

[11] 4,193,447

[45] Mar. 18, 1980

[54] HEAT EXCHANGER FOR A HIGH TEMPERATURE REACTOR

[75] Inventor: Robert Fah, Seuzach, Switzerland

[73] Assignee: Sulzer Brothers Limited, Winterthur, Switzerland

[21] Appl. No.: 862,003

[22] Filed: Dec. 19, 1977

[30] Foreign Application Priority Data

Dec. 21, 1976 [CH] Switzerland ..... 16079/76

[51] Int. Cl.[2] ..... F28F 9/22; F28B 1/02; G21C 19/28

[52] U.S. Cl. ..... 165/145; 165/140; 165/142; 122/32; 176/60; 176/65

[58] Field of Search ..... 165/140, 142, 157, 160, 165/74, 145; 122/32; 176/60, 65

[56] References Cited

U.S. PATENT DOCUMENTS 3,534,812 10/1970 Sandri ..... 165/140

4,029,055 6/1977 Haese ..... 122/32

4,083,695 4/1978 Haese et al. ..... 165/142

*Primary Examiner*—Charles J. Myhre

*Assistant Examiner*—M. Moy

*Attorney, Agent, or Firm*—Kenyon & Kenyon

[57] ABSTRACT

The two heating surfaces of the exchanger are both provided within a jacket. The first heating surface is formed, in part, by blind tubes which project into the casing through which the primary gas flows. The second heating surface is disposed in the space between the feed pipe and the jacket and receives the flow of primary gas after the primary gas has passed over the blind tubes. The secondary gas passes into the interior of the blind tubes while a working medium flows through the second heat exchanger in heat exchange relation with the primary gas. Some of the returning cooled primary gas can be tapped off and supplied as a coolant through the tube plate in which the blind tubes are mounted.

6 Claims, 1 Drawing Figure

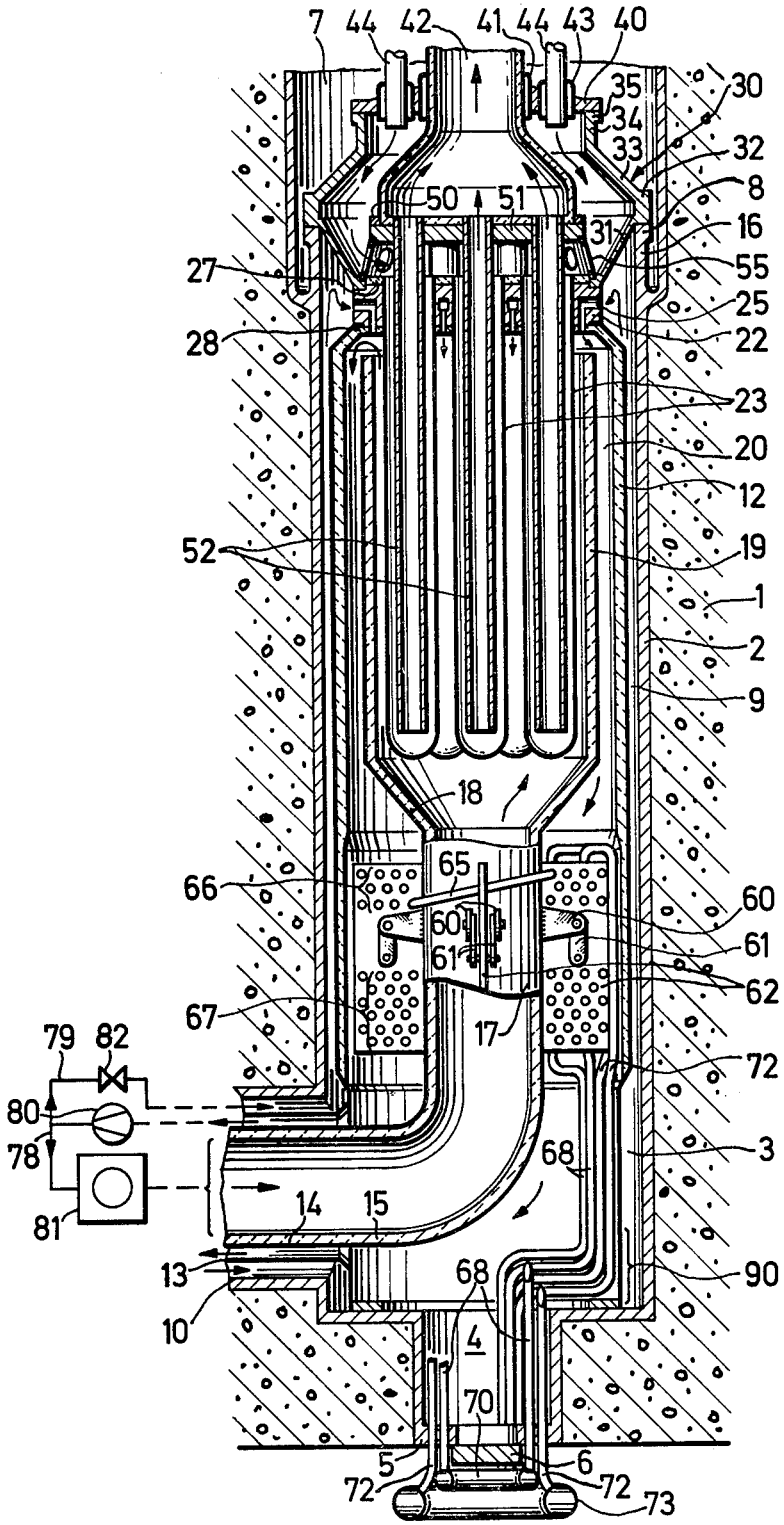
7
44
42
41
44
43
40
35
34
33
30
32
8
16
55
25
22
23
20
12
19
1
2
9
50
51
31
27
28
52
18
65
66
60
61
62
67
17
79
82
80
78
81
72
3
68
14
15
13
10
90
68
4
70
5
6
72
72
73

HEAT EXCHANGER FOR A HIGH TEMPERATURE REACTOR

This invention relates to a heat exchanger and, more particularly, to a heat exchanger for a high temperature reactor.

As is known, various types of heat exchangers have been used in combination with nuclear reactor plants in order to cool down the hot primary gas flowing from the reactor. Usually, these heat exchangers have a first heating surface in which heat transfer takes place between the primary gas from the reactor and a secondary gas as well as a second heating surface which places the cooled primary gas in further heat exchange relation with a working medium which can be heated to produce a vapor and, if required, a super-heated vapor.

In some cases, the first heating surface is formed of a nest of parallel blind tubes which terminate in a tube plate and which are surrounded by a casing. Usually, an inner tube extends into each of the blind tubes so that the secondary gas flows in parallel first through the spaces formed between a blind tube and the associated inner tube and then through the inner tubes. In this construction, the primary gas is directed to the first heating surface via a pipe which is usually coaxial with respect to the nest of blind tubes and which is connected to the casing. In addition, the second heating surface has usually been disposed around the casing which surrounds the first heating surface.

However, heat exchangers which are constructed in the above manner have a disadvantage in that the boundary walls surrounding the second heating surface internally and externally have a considerable peripheral length. As a result, such boundary walls always form certain discontinuities for the primary gas which flows around the second heating surface and may cause an uneven temperature distribution within the primary gas flow.

Accordingly, it is an object of this invention to reduce the peripheral size of the boundary walls surrounding the second heating surface in a heat exchanger of the above type.

It is another object of the invention to reduce the incidence of discontinuity in the flow of a primary gas within a heat exchanger of the above type.

It is another object of the invention to provide a uniform temperature distribution within a primary gas flowing from a nuclear reactor through the various heating surfaces of a heat exchanger.

Briefly, the invention provides a heat exchanger for a high temperature reactor which is comprised of a casing, a pair of heating surfaces, a feed pipe and a jacket. The first heating surface includes a tube plate, a nest of blind tubes extending within the casing and terminating in the tube plate, and a plurality of inner tubes each of which extends concentrically within a respective blind tube to define a flow path having parallel sections for a flow of a secondary gas. The feed pipe is disposed coaxially of the nest of blind tubes for supplying a flow of hot primary gas over the nest of blind tubes for heat exchange with the secondary gas. This pipe also has a funnel-shaped widened portion which is connected to the casing. The jacket extends from the tube plate in concentric spaced relation to the casing and to the feed pipe to define an annular passage for the flow of primary gas downstream of the first heating surface. The second heating surface is located between the feed pipe and the jacket in the annular passage for heating a working medium in heat exchange relation with the flow of primary gas.

The second heating surface is constructed, for example, of at least one nest of tubes which helically surround the feed pipe. In addition, a means is provided for suspending the nest of helical tubes from the feed pipe.

In order to facilitate passage of the primary gas from the inside to the outside of the casing, the casing is spaced from the tube plate to define a gap for passage of the flow of primary gas.

Any suitable means is provided for supplying the secondary gas to the first heating surface such that the secondary gas flows first into the blind tubes and then into the tubes within each blind tube.

In this heat exchanger construction, the feed pipe carrying the primary gas to the first heating surface is smaller than the casing which surrounds the first heating surface. Thus, it is possible, in conjunction with the jacket disposed on the tube plate, to create a sufficient space between the jacket and the feed pipe to accommodate the second heating surface. As a result, the peripheral length of the jacket (i.e. outer wall) bounding the second heating surface is not much more than the corresponding length of the casing surrounding the first heating surface. Also, the peripheral length of the casing (i.e. inner wall) is considerably smaller, i.e. approximately one-half. Hence, the incidence of discontinuities in the flow of primary gas and of uneven temperature distributions is greatly reduced.

The heat exchanger provides a substantially uniform temperature profile which is further assisted by the fact that the funnel-shaped widened portion of the feed pipe and the jacket form a diffusor in the direction of flow of the primary gas. This has a favorable effect on the primary gas flow before the primary gas flows around the second heating surface. The smaller diameter of the outer boundary wall of the second heating surface (i.e. the jacket) is particularly advantageous if the heat exchanger is accommodated in a cavity of a concrete pressure vessel since the entire pressure vessel can be made smaller. Any cover used to close the cavity may also be made smaller. This not only reduces the expense of construction but also facilities servicing of the heat exchanger.

The heat exchanger can be particularly utilized in a nuclear reactor plant. In this case, the heat exchanger can be housed in a concrete pressure vessel having a cylindrical cavity, while the reactor is housed in the vessel in spaced relation to the cavity. In this case, both the first and second heating surfaces are accommodated in the cylindrical cavity of the pressure vessel.

In order to maintain the concrete wall of the cavity at a relatively low temperature level as well as the tube plate in which the blind tubes of the first heating surface are connected, a relatively simple coolant circuit can be provided. To this end, the jacket of the heat exchanger is spaced from the pressure vessel to define an annular gap and a plurality of cooling ducts are provided in the tube plate to communicate the annular gap with the interior of the casing about the nest of blind tubes. Also, a means is provided for returning the flow of primary gas from the annular passage in which the second heating surface is disposed to the reactor as well as a means for tapping the return flow of primary gas between the second heating surface and the reactor in order to supply a part-flow to the annular gap between the jacket and concrete wall. This part flow thus cools the concrete wall of the vessel as well as the jacket and tube plate.

These and other objects and advantages of the invention will become more apparent from the following detailed description taken in conjunction with the accompanying drawing in which:

The FIGURE illustrates a vertical sectional view through a heat exchanger according to the invention.

Referring to the drawing, a nuclear reactor plant is provided with a concrete pressure vessel 1 which has a cylindrical cavity 3 lined with a lining plate 2. As shown, the cavity 3 is disposed on a vertical axis and is provided at the bottom end with a vertical duct 4 of smaller diameter. The lining plate 2 also lines the duct 4 and merges into an inner flange 5 at the bottom. A cover 6 is detachably secured in any suitable manner (not shown) to the flange 5. The upper part of the cavity 3 widens out somewhat and the lining plate 2 which lines the widened part 7 has an annular portion 16 which projects into the widened part 7 and terminates at a flange 8.

As shown, a heat exchanger is disposed within the cylindrical cavity 3 of the pressure vessel. This heat exchanger includes a jacket 12 which is disposed within the cavity 3 in spaced relation to the lining 2 on the pressure vessel wall in order to define an annular gap 9. This jacket 12 is connected in seal tight relation to the bottom of the cavity 3 and extends upwardly into the vicinity of the widened part 7 of the cavity 3. The lowermost quarter of the jacket 12 can be subdivided into two parts by expansion elements (not shown) to allow a relative axial movement between the two parts. As indicated, the inside of the jacket 12 is provided with thermal insulation over the upper three-quarters.

The pressure vessel is provided with a duct 10 of round cross-section in the lower part of the cavity 3 in order to connect the cavity 3 to a cavity (not shown) which accommodates a high temperature nuclear reactor 81. As shown, a tube 13 extends inside the duct 10 in radially spaced relation and is connected to the bottom part of the jacket 12. In addition, a feed pipe 14 having thermal insulation 15 on the inside extends within the tube 13 in radially spaced relation. This feed pipe 14 merges into a vertical feed pipe 17 inside the bottom zone of the cavity 3. This vertical pipe 17 has a funnel-shaped widened portion 18 at the upper end which is connected to a casing 19. The casing 19, in turn, extends upwardly in concentric spaced relation to the jacket 12 and terminates just beneath the top end of the jacket 12. The vertical pipe 17, widened portion 18 and casing 19 also have thermal insulation on the inside. In addition, an annular gap 20 is formed between the casing 19 and the jacket 12.

The heat exchanger has a first heating surface within the cavity 3 and particularly within the casing 19. As shown, this heating surface includes a tube plate 22, a nest of blind tubes 23 which extend within the casing 19 and terminate in the tube plate 22, and a plurality of inner tubes 52 each of which extends concentrically within a blind tube 23 to define a flow path having parallel sections for a flow of a secondary gas. As shown, the top end of the jacket 12 is drawn in conically and is connected in seal tight relation to the tube plate 22. In addition, the blind tubes 23, are welded in seal tight relation to the plate 22 and are distributed within the plate 22 in a triangular pattern.

Further, the tube plate 22 is provided with thermal insulation 27 at the top and thermal insulation 28 at the bottom. The tube plate 22 also has a plurality of cooling ducts 25 which communicate the annular gap 9 between the jacket 12 and the lining 2 on the pressure vessel wall with the interior of the casing 19 about the nest of blind tubes 23. As indicated, the cooling ducts 25 start from the circumferential surface of the tube plate 22 and terminate in a lower surface of the tube plate 22.

A means is provided for supplying a secondary gas to the first heating surface. This means includes an annular member 30 which is connected via bolts (not shown) to the tube plate 22. This annular member consists of a bottom cone 31 which widens outwardly in the upward direction, a flange 32 connected to the cone 31, a top cone 33 which tapers inwardly in an upward direction from the flange 32 and a cylindrical portion 34 which terminates in a flange 35. The flange 32 of the annular member 30 rests on the flange 8 of the lining plate 2 and is connected in seal tight relation to the flange 8. In addition, a cover 40 rests on the flange 35 of the annular member 30 and a pipe 42 passes through the center of the cover 40. This pipe 42 is connected in seal tight relation to the cover 40 via a bellows 41 which allows thermal expansion. In addition, a plurality of pipes 44 are disposed around the central pipe 42 and terminate just beneath the cover 40. These pipes 44 are each connected in seal tight relation to the cover 40 via a bellows 43 which permits thermal expansion. As shown, the pipe 42 widens outwardly in the downward direction beneath the cover 40 and terminates in a flange 50 which is connected in seal tight relation to a tube plate 51 in which the inner tubes 52 are inserted in seal tight relation. The pipe 42, inner tubes 52 and tube plate 51 are provided with thermal insulation on the inside and on the top, respectively. Apart from being fixed to the flange 50, the tube plate 51 is supported on the bottom end of the annular member 30 via a readily flexible perforated cone 55.

A second heating surface is located between the feed pipe 17 and the jacket 12 in the annular passage 20. As indicated, this heating surface is composed of a plurality of drilled carrier plates 62 (e.g. four) in which helically coiled tubes 65 are accommodated in bore holes in known manner to form two nests 66, 67. As shown, the tubes 65 helically surround the feed pipe 17 below the widened portion 18. In addition, a means is provided for suspending the nests 66, 67 of helical tubes from the feed pipe 17. This means includes four pairs of radial brackets 60 on the outside of the vertical pipe 17 and straps 61. Each strap 61 is pivotally connected to a pair of brackets 60 and to a respective drilled carrier plate 62.

The bottom tube ends of the nest 67 are connected to an annular distributor 70 via tubes 68 which extend through the duct 4 and the inner flange 5. A suitable feed water supply pipe (not shown) is connected to the distributor 70 in order to deliver feed water to the distributor 70. The top tube ends of the nest 66 are connected to an annular header 73 via tubes 72, which also extend through the duct 4 and the inner flange 5. A suitable vapor discharge pipe (not shown) is connected to the header 73 to draw off any vapor. The tubes 68, 72 extend substantially tangentially to the two pitched circles over which they penetrate the inner flange 5 within the zone 90 so that relatively long horizontal expansion limbs are formed in the zone 90. The top tube ends of the nest 67 are connected to the bottom tube ends of the nest 66 via suitable tubes (not shonw).

A means is also provided for returning the flow of primary gas from the annular passage 20 to the reactor 81. To this end, the annular space between the pipe 14 and the tube 13 inside the duct 13 leads to a blower 80 (shown diagrammatically). The outlet side of the blower 80 is connected via a pipe 78 to the reactor 81 to deliver the cooled primary gas while a means for tapping the returned flow of primary gas is provided to tap off a part flow of the cooled primary gas. This latter means includes a pipe 79 which leads from the outlet side of the blower 80 and an adjustable throttle 82 within the pipe 79. The pipe 79 connects with the annular gap 9 between the lining plate 2 and the jacket 12 while the throttle 82 serves to control the amount of primary gas tapped off from the return flow between the second heating surface and the reactor 81. As indicated, the outlet of the reactor 81 is connected to the pipe line 14.

In operation, a hot primary gas, for example, at a temperature of 950° C., flows from the reactor 81 through the pipes 14, 17 into the space enclosed by the casing 19 and containing the nest of blind tubes 23. The primary gas gives up part of the heat absorbed in the reactor 81 to the tubes 23 and is deflected through the gap between the casing 19 and the tube plate 22 into the annular chamber 20.

At the same time, a secondary gas is supplied through the pipes 44 into the space between the annular member 30 and the pipe 42. This secondary gas flows through the perforations in the cone 55 into the space between the two tube plates 51, 22. The secondary gas flows through the annular spaces between the blind tubes 23 and the inner tubes 52 to the bottom end of the blind tubes 23 and, then, through the inner tubes 52 into the collecting chamber formed above the tube plate 51 by the widened portion of the pipe 42. During the flow through the parallel sections defined by the blind tubes 23 and tubes 52, the secondary gas is heated by the heat transferred from the primary gas. The heated secondary gas is then exhausted from the pipe 42 to a stage (not shown) of a technical process, for example, a catalyst-assisted endothermic chemical reaction, or for purposes of fission.

As the primary gas flows into the annular passage 20, the tapped gas from the previous cooled primary gas is mixed in via the pipe 79, throttle 82, annular gap 9 and cooling ducts 25. The resulting gas mixture then flows through the annular passage 20 and reaches the tube nest 66 of the second heating surface at a temperature of about 700° C. The gas then flows around the nest 66 and the nest 67 and is cooled to about 300° C. The primary gas is then directed to the blower 80 at this temperature. Part of this cooled primary gas flows via the pipe 78 into the reactor 81 and part via the pipe 79 into the annular gap 9. Only a small portion of the cooled primary gas is tapped off via the pipe 79. To this end, the amount is sufficient to bring about a cooling of the tube plate 22.

During operation, feed water flows from the annular distributor 70 via the tubes 68 into the tube nest 67, is heated and evaporated therein. The resultant vapor is then fed to the tube next 66 and superheated therein. The resulting superheated live vapor or steam then flows through the tubes 72 and the annular header 73 to a suitable consumer, for example, a steam turbine or to a stage of a process.

It is to be noted that it is also possible to dispose the straps 61 of the carrier plates 62 on the jacket 12 and to suspend the feed pipe 17 from the carrier plate 62 or the carrier elements. Depending upon the temperatures which occur and the materials used, it may be advantageous to protect the carrier plates from high temperatures. To this end, the tubes 72 may be extended upwardly beyond the carrier plates 62 to form tube loops which may extend into the annular passage 20. Also, instead of using tube loops, blind tubes may project into the annular passage 20 with inner tubes disposed therein.

Because the heating surface composed of the helically coiled tube 65 is located below the widened portion 18 of the feed pipe 17, an advantageous effect is obtained. Specifically, this mounting arrangement allows the space below the widened portion 18 to be utilized for housing additional heating surfaces. As a result, the diameter of the entire heat exchanger is smaller than if the additional heating surfaces were arranged in the annular passage 20 above the widened portion 18.

What is claimed is:

1. A heat exchanger for a high temperature reactor comprising a casing;

a first heating surface including a tube plate spaced from said casing to define a gap therebetween, a nest of blind tubes extending within said casing and terminating in said tube plate, and a plurality of inner tubes, each said inner tube extending concentrically within a respective blind tube to define a flow path having parallel sections for a flow of a secondary gas;

a feed pipe disposed coaxially of said next of blind tubes for supplying a flow of hot primary gas over said nest of blind tubes for heat exchange with the secondary gas, said pipe having a funnel-shaped widened portion connected to said casing;

a jacket extending from said tube plate in concentric spaced relation to said casing and to said feed pipe to define an annular passage for the flow of primary gas downstream of said gap and said first heating surface; and a second heating surface located between said feed pipe and said jacket in said annular passage below said widened portion for heating a working medium in heat exchange relation with the flow of primary gas.

2. A heat exchanger as set forth in claim 1 wherein said second heating surface includes at least one nest of tubes helically surrounding said feed pipe.

3. A heat exchanger as set forth in claim 2 which further includes means suspending said nest of helical tubes from said feed pipe.

4. A heat exchanger as set forth in claim 1 which further comprises means for supplying the secondary gas to said first heating surface.

5. A heat exchanger comprising a casing;

a first heating surface including a tube plate spaced from said casing to define a gap therebetween, a nest of blind tubes extending from said tube plate into said casing, and a plurality of inner tubes, each said inner tube extending concentrically within a respective blind tube to define a flow path having parallel sections for a flow of secondary gas;

means for supplying a flow of secondary gas to said first heating surface;

a feed pipe disposed below and coaxially of said nest of blind tubes for supplying a flow of hot primary gas over said nest of blind tubes for heat exchange with the secondary gas, said pipe having a funnel-shaped widened portion connected to said casing;

a jacket extending from said tube plate in concentric spaced relation to said casing and to said feed pipe to define an annular passage for the flow of primary gas downstream of said first heating surface; and a second heating surface located between said feed pipe and said jacket in said annular passage below said widened portion for heating a working medium in heat exchange relation with the flow of primary gas, said second heating surface including at least one nest of tubes helically surrounding said feed pipe.

6. In combination, a concrete pressure vessel having a cylindrical cavity;

a reactor housed in said vessel in spaced relation to said cavity;

a casing within said cavity;

a first heating surface in said cavity including a tube plate, a nest of blind tubes extending within said casing and terminating in said tube plate, and a plurality of inner tubes, each said inner tube extending concentrically within a respective blind tube to define a flow path having parallel sections for a flow of a secondary gas;

a feed pipe disposed coaxially of said nest of blind tubes for supplying a flow of hot primary gas from said reactor over said nest of blind tubes for heat exchange with the secondary gas, said pipe having a funnel-shaped widened portion connected to said casing;

a jacket extending from said tube plate in concentric spaced relation to said casing and to said feed pipe to define an annular passage for the flow of primary gas downstream of said first heating surface, said jacket being spaced from said pressure vessel to define an annular gap;

a second heating surface located between said feed pipe and said jacket in said annular passage for heating a working medium in heat exchange relation with the flow of primary gas;

a plurality of cooling ducts in said tube plate communicating said annular gap between said jacket and pressure vessel with the interior of said casing about said nest of blind tubes;

means for returning the flow of primary gas from said annular passage to said reactor; and means for tapping the return flow of primary gas between said second heating surface and said reactor to supply a part flow thereof to said annular gap.

* * * * *